US005277423A

United States Patent [19]

Artus

[11] Patent Number: 5,277,423

[45] Date of Patent: Jan. 11, 1994

[54] VIBRATION-DAMPING DEVICE FOR AN INSTRUMENT HAVING A SHAFT AND A STRIKING HEAD

[75] Inventor: Jean P. Artus, Grenoble, France

[73] Assignee: Skis Rossignol S.A., France

[21] Appl. No.: 913,003

[22] Filed: Jul. 14, 1992

[30] Foreign Application Priority Data

Aug. 28, 1991 [FR] France ..... 91 10849

[51] Int. Cl.[5] ..... A63B 53/00

[52] U.S. Cl. ..... 273/80 R; 273/80.1; 273/80.2

[58] Field of Search .....273/80 R, 80.2, 80.3, 80.4, 81 D, 165, 67 R, 73 R; 81/20, 22, 489

[56] References Cited

U.S. PATENT DOCUMENTS

| | | | |
|---|---|---|---|
| 1,894,706 | 1/1933 | Reach | 273/80.4 |
| 1,894,707 | 1/1933 | Reach | 273/80.4 |
| 1,906,239 | 5/1933 | Reach | 273/80.4 |
| 1,946,007 | 7/1934 | Watson | 273/80.4 |
| 1,953,604 | 4/1934 | Heller | 273/80.4 |
| 1,980,408 | 11/1934 | Jansky | 273/80.4 |
| 2,129,068 | 9/1938 | Reach | 273/80.4 |
| 4,736,949 | 4/1988 | Muroi . | |

FOREIGN PATENT DOCUMENTS

| | | |
|---|---|---|
| 901416 | 4/1985 | Belgium . |
| 2575393 | 7/1966 | France . |

*Primary Examiner*—Mark S. Graham
*Assistant Examiner*—Raleigh W. Chiu
*Attorney, Agent, or Firm*—Parkhurst, Wendel & Rossi

[57] ABSTRACT

A vibration-damping device for an instrument including a shaft for gripping (1) and a striking head (3, 4), in which the shaft has a rigid tubular sleeve (11), coaxial with the shaft (1), wherein this sleeve (11) is connected to the shaft (1) by a viscoelastic material (12) of 0.2 to 3 mm in thickness which is stressed by the sleeve (11) on the shaft (1).

21 Claims, 2 Drawing Sheets

VIBRATION-DAMPING DEVICE FOR AN INSTRUMENT HAVING A SHAFT AND A STRIKING HEAD

BACKGROUND OF THE INVENTION

The invention relates to a vibration-damper device for an instrument comprising a shaft for gripping and a striking head; it also related to instruments thus equipped.

The expression "instrument including a shaft for gripping and a striking head" encompasses both tools; hammers and sports articles such as golf clubs, baseball bats, or indeed ski sticks or bows for archery.

It is known that, on striking, these instruments, and more accurately their shaft, vibrate and the vibrations produced are detrimental both for the user and for the accuracy of the strike.

Vibration-damping devices consisting of a plate having a high elastic modulus and assembled by adhesively bonding to the part to be damped by means of a viscoelastic material have been known for a long time. These damping devices are well known and used widely in fields as varied as the suspension for a machine tool or for engines of any type. In FR-A-2,575,393 of the Applicant, one application of this device has been proposed for the ski industry.

SUMMARY OF THE INVENTION

The invention relates to a vibration-damping device for an instrument comprising a shaft for gripping and a striking head, in which the shaft has a rigid tubular sleeve, coaxial with the shaft, wherein this sleeve is connected to the shaft by a viscoelastic material of 0.2 mm to 3.0 mm in thickness which is constrained by the sleeve on the shaft.

In other words, the invention consists in applying on the shaft for gripping not a plate but a rigid, tubular constraining sleeve, connected to the shaft by a viscoelastic material of predetermined thickness. The stressing or constraining of the sleeve on the shaft then serves as a vibration-damping device by absorption of the energy released during the strike by converting it into heat.

Thus, the characteristic viscoelastic intermediate element is locked in place between two elements, respectively one deformable, namely the shaft, and the other rigid and non-deformable, namely the sleeve. Thus, the characteristic viscoelastic material, subjected to shear, acts as a damper or shock adsorber, by following the distorsions of the shaft.

As is known, "viscoelastic materials" are materials which lead to the reduction in the amplitude of the vibrations by degradation of a portion of the deformation energy in the form of heat. These materials generally have low elastic modulus, especially Young's modulus, but high intrinsic damping coefficients.

It goes without saying that the characteristic damping assembly of the invention must be positioned along the shaft at a suitable location corresponding to a vibration antinode region or, more precisely, at the point of maximum disturbance of this vibration antinode region, which the person skilled in the art determines in a known way depending on the anticipated application.

Advantageously, in practice the rigid sleeve has an elastic modulus E greater than 10,000 MPa and a thickness between 0.1 and 3 mm, preferably in the vicinity of 1 mm. It has been observed that if the elastic modulus is less than 10,000 MPa, the rigid sleeve does not act as a constraining plate and the damping is less effective. Likewise, if the thickness is less than 0.1 mm, a damping effect is no longer obtained, whereas if it exceeds 3 mm the cost and the weight are unnecessarily increased without corresponding improvement.

The rigid sleeve having a high elastic modulus is chosen from the group consisting of aluminum alloys, aluminum-chromium-zinc alloys, laminated thermosetting materials reinforced with glass or carbon fibers, thermoplastic materials reinforced with glass or carbon fibers.

The viscoelastic material is in the form of a sleeve coaxial with the shaft and with the rigid sleeve, of thickness between 0.2 and 3 mm, preferably in the vicinity of 0.8 mm. It has been observed that if the layer of viscoelastic material is less than 0.2 mm a damping effect is no longer obtained and if this layer exceeds 3 mm no proportional improvement is obtained.

In one advantageous embodiment, the intermediate viscoelastic material is in the form of a stack of elementary layers or of a juxtaposition of layers the whole of which is coated over its two, respectively inner and outer, faces with an adhesive layer intended to connect this sleeve respectively to the outer face of the shaft and to the inner face of the rigid sleeve.

The viscoelastic material preferably is chosen from the group consisting of butyl rubbers, synthetic elastomers, alone, as a mixture or filled.

In one embodiment, the characteristic damping assembly can slide along the shaft and can then be fixed by any suitable means, such as screwing or clamping, along the latter, preferably at a vibration antinode region or, more precisely, at the point of the maximum disturbance of a vibration antinode region, which maximum disturbance is determined in a known way by trial-and-error methods.

In another embodiment, the characteristic damping assembly is positioned in a restriction made for this purpose on the shaft.

It goes without saying that the cross section of the shaft can be varied, e.g., polygonal, ovoid, circular or of other shape.

Although the invention is particularly adapted to the shaft of golf clubs, it may also be adapted to the shaft of striking tools, such as a hammer.

BRIEF DESCRIPTION OF THE DRAWINGS

The manner in which the invention may be produced and the advantages which stem therefrom will emerge more clearly from the embodiments which follow with the aid of the attached figures.

DETAILED DESCRIPTION OF THE INVENTION

Figure 1:
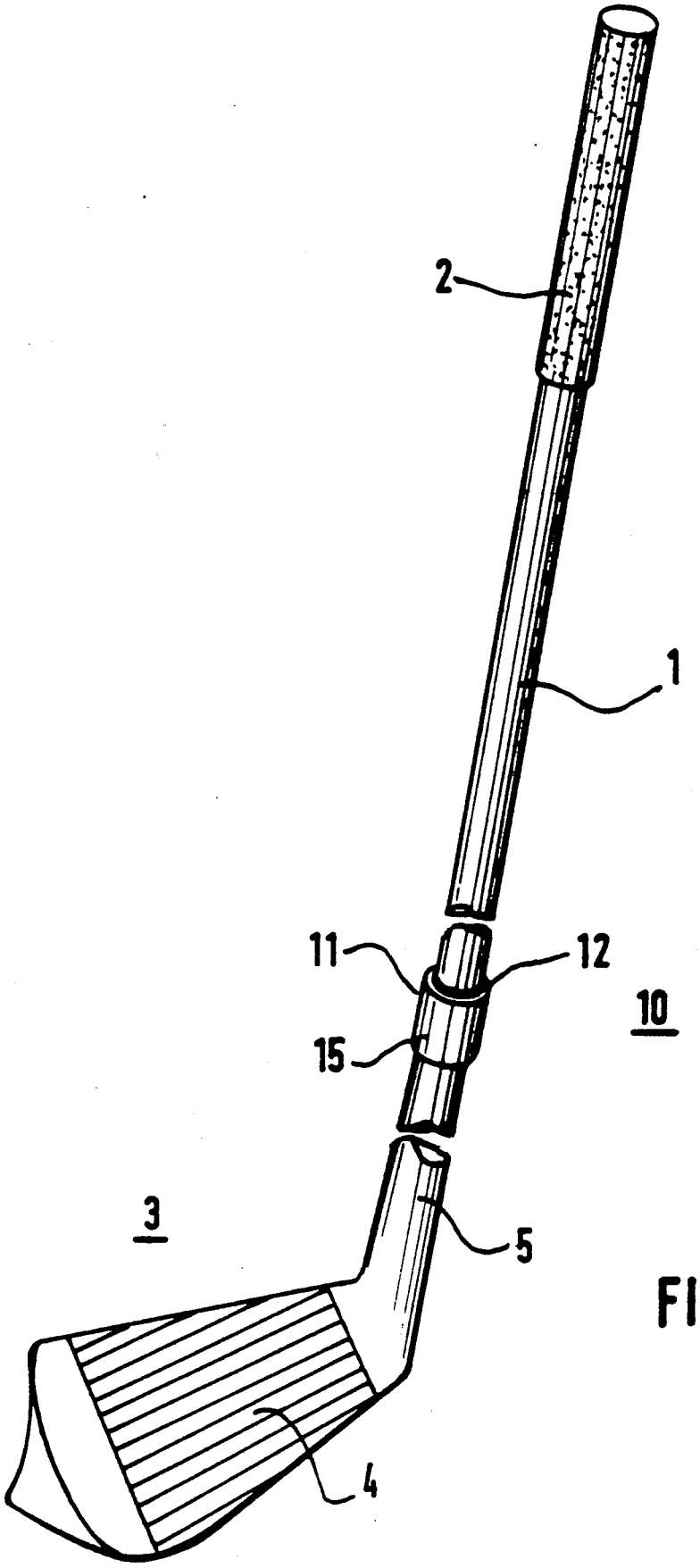
FIG. 1 shows a golf club (iron) in summary perspective in accordance with the invention.
Figure 2:
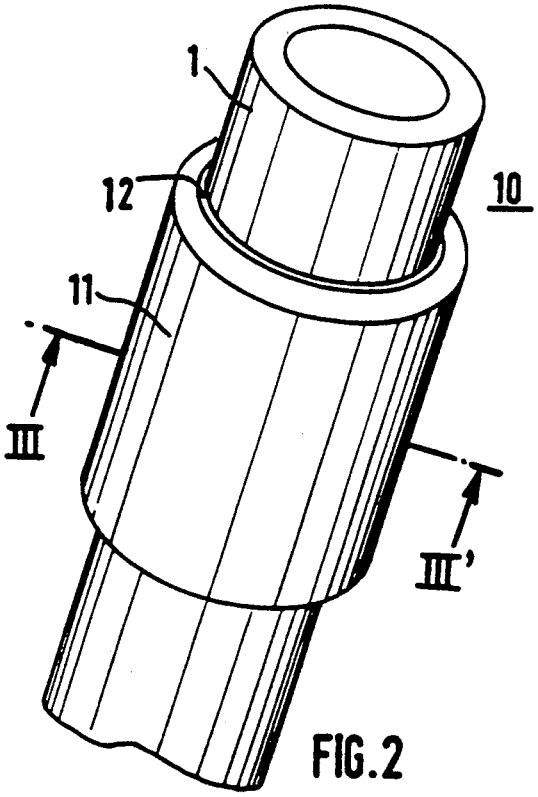
FIGS. 2 and 3 show a detail of this club represented respectively in summary perspective view (FIG. 2) and in cross section (FIG. 3) along the plane III—III'.
Figure 3:
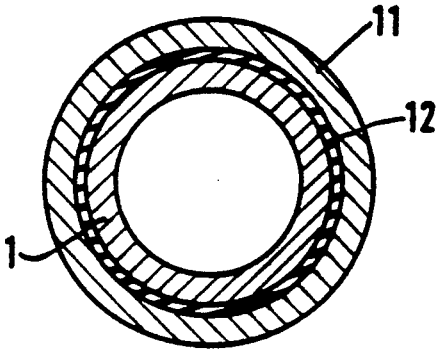

A golf iron in accordance with the invention comprises a shaft (1), for example made from metal, terminated at its end by a grip (2) and connected at its other end to a head designated by the general reference (3), having a striking face (4). A hosel (5) connects the head (3) to the shaft (1).

The characteristic damping assembly of the invention, designated by the general reference (10), comprises a rigid tubular sleeve (11) made from an aluminum-chromium-zinc alloy known under the name ZICRAL (registered trade mark of CEGEDUR), having an elastic modulus of 12,000 MPa, a thickness of 0.8 mm, a height of 40 mm and an internal diameter of 12 mm.

This damping assembly (10) is positioned on the shaft (15) at a location corresponding to a vibration antinode determined beforehand by any known means. On a golf club shaft, this antinode is located in the vicinity of the first third of the shaft (1) starting from the head (3).

The circular rigid tubular sleeve (11) is connected at (15) to the shaft (1), which is also circular, by means of a second sleeve (12) which is coaxial both with the shaft (1) and with the rigid sleeve (11) having a high elastic modulus and the two, respectively inner and outer, faces of which have been coated beforehand with an adhesive layer (not shown) so as to promote the mechanical integrity between the rigid stressing sleeve (11) and the shaft (1). The viscoelastic intermediate linking layer (12) has a coefficient of damping at 25° C., tan $\delta$, between 0.4 and 1.2, preferably between 0.6 and 0.8.

By positioning the damping assembly (10) along the shaft (1) at the point of maximum disturbance of the vibration antinode region (15), a distinct improvement in the damping of the vibrations is observed.

In a variant not shown, the characteristic damping element (10) can slide temporarily along the shaft (1). In order to do this, the intermediate viscoelastic layer (12) adheres only to the outer rigid sleeve (11) and does not adhere to the shaft (1), in order to permit this sliding. The user determines, by trial-and-error methods, the location of the vibration antinode region (15) and then positions this damping element by any known means, such as screwing, adhesive bonding or clamping.

Figure 4:
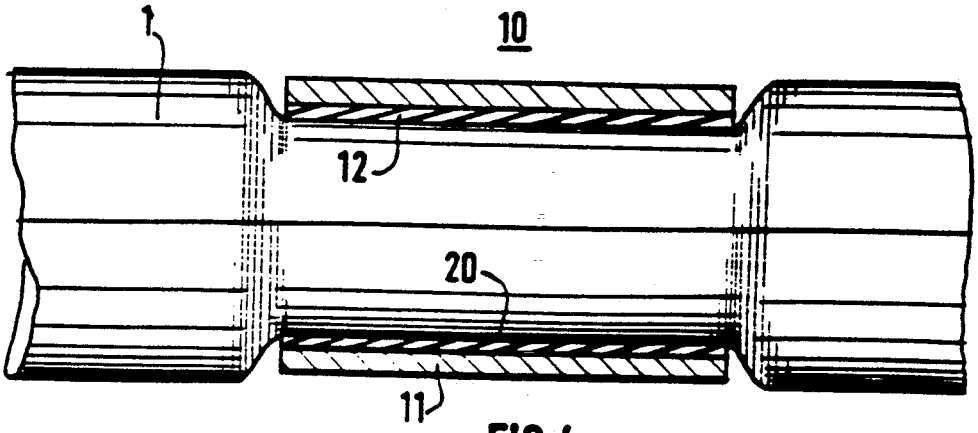
FIG. 4 is another embodiment of the invention shown in longitudinal cross section.

FIG. 4 is another embodiment of the invention in which the shaft (1) has a restriction (20) into which will be inserted the damping element (10) whose internal diameter corresponds substantially to the outer diameter of the tube. This embodiment has the advantage of maintaining a uniform cross section for the shaft.

I claim:

1. A golf club comprising:

a striking head having a hosel extending therefrom;

a shaft having a first end fixed within said hosel, a second end terminated by a grip and a length L; and vibration damping means fixed on said shaft at a position about $\frac{1}{3}$ L from said striking head, said vibration damping means comprising a viscoelastic layer, having a thickness of 0.2 to 3.0 mm, fixed to an outer surface of said shaft and a rigid tubular sleeve fixed to said viscoelastic layer to thereby constrain said viscoelastic layer.

2. The golf club of claim 3, wherein said viscoelastic layer has a damping coefficient at ambient temperature between 0.4 to 1.2.

3. The golf club of claim 2, wherein said viscoelastic layer comprises a material selected from the group consisting of butyl rubbers, synthetic elastomers, alone, as a mixture or filled.

4. The golf club of claim 1, wherein said viscoelastic layer has an adhesive coated on inner and outer surfaces thereof to fix said inner surface to said shaft and said outer surface to said rigid tubular sleeve.

5. The golf club of claim 4, wherein said viscoelastic layer is formed from a superposition of elementary layers.

6. The golf club of claim 1, wherein said rigid tubular sleeve has an elastic modulus E greater than 10,000 MPa, a thickness between 0.1 and 3 mm, and comprises a material selected from the group consisting of aluminum alloys, aluminum-chromium-zinc alloys, laminated thermosetting materials reinforced with glass or carbon fibers and thermoplastic materials reinforced with glass or carbon fibers.

7. The golf club of claim 1, wherein said vibration damping means is slidable temporarily along said shaft and then fixed along said shaft at a point of maximum disturbance of a vibration antinode region.

8. The golf club of claim 1, wherein said shaft includes an annular recess for receiving therein said vibration damping means.

9. A golf club comprising a striking head having a hosel extending therefrom, a shaft connected at one end to said hosel and having a grip at an other end thereof, wherein the shaft comprises along its length between the hosel and the grip vibration damping means consists of a rigid tubular sleeve, coaxial to the shaft, connected to the shaft by a viscoelastic layer constrained by the sleeve on the shaft, said viscoelastic layer having a thickness of 0.2 to 3.0 mm.

10. The golf club of claim 9, wherein said viscoelastic layer has a damping coefficient at ambient temperature between 0.4 to 1.2.

11. The golf club of claim 10, wherein said viscoelastic layer comprises a material selected from the group consisting of butyl rubbers, synthetic elastomers, alone, as a mixture or filled.

12. The golf club of claim 9, wherein said viscoelastic layer has an adhesive coated on inner and outer surfaces thereof to fix said inner surface to said shaft and said outer surface to said rigid tubular sleeve.

13. The golf club of claim 12, wherein said viscoelastic layer is formed from a superposition of elementary layers.

14. The golf club of claim 9, wherein said rigid tubular sleeve has an elastic modulus E greater than 10,000 MPa, a thickness between 0.1 and 3 mm, and comprises a material selected from the group consisting of aluminum alloys, aluminum-chromium-zinc alloys, laminated thermosetting materials reinforced with glass or carbon fibers and thermoplastic materials reinforced with glass or carbon fibers.

15. The golf club of claim 9, wherein said vibration damping means is slidable temporarily along said shaft and then fixed along said shaft at a point of maximum disturbance of a vibration antinode region.

16. The golf club of claim 9, wherein said shaft includes an annular recess for receiving therein said vibration damping means.

17. A golf club comprising:

a striking head having a hosel extending therefrom;

a shaft having a first end fixed within said hosel, a second end terminated by a grip and a length L; and vibration damping means fixed on said shaft at a position about $\frac{1}{3}$ L from said striking head, said vibration damping means comprising a viscoelastic layer, fixed to an outer surface of said shaft and a rigid tubular sleeve fixed to said viscoelastic layer to thereby constrain said viscoelastic layer, wherein said viscoelastic layer has a thickness of 0.2 to 3.0 mm, a damping coefficient at ambient temperature between 0.4 and 1.2, and an adhesive coated on inner and outer surfaces thereof to fix said inner surface to said shaft and said outer surface to said rigid tubular sleeve, and said rigid tubular sleeve has an elastic modulus E greater than 10,000 MPa, a thickness between 0.1 and 3 mm, and comprises a material selected from the group consisting of aluminum alloys, aluminum-chromium-zinc alloys, laminated thermosetting materials reinforced with glass or carbon fibers and thermoplastic materials reinforced with glass or carbon fibers.

18. The golf club of claim 17, wherein said viscoelastic layer comprises a material selected from the group consisting of butyl rubbers, synthetic elastomers, alone, as a mixture or filled.

19. The golf club of claim 17, wherein said viscoelastic layer is formed from a superposition of elementary layers.

20. The golf club of claim 17, wherein said vibration damping means is slidable temporarily along said shaft and then fixed along said shaft at a point of maximum disturbance of a vibration antinode region.

21. The golf club of claim 17, wherein said shaft includes an annular recess for receiving therein said vibration damping means.

* * * * *